US011192678B2

(12) United States Patent
Fazelinejad et al.

(10) Patent No.: US 11,192,678 B2
(45) Date of Patent: Dec. 7, 2021

(54) CLOSURES FOR CARTON BOARD PACKAGING OF GABLE TOP TYPE AND SEALING THEREOF

(71) Applicant: AB Merculor, Hagersten (SE)

(72) Inventors: Babak Fazelinejad, Boras (SE); Robert Svanberg, Hagersten (SE)

(73) Assignee: AB MERCULOR, Hagersten (SE)

( * ) Notice: Subject to any disclaimer, the term of this patent is extended or adjusted under 35 U.S.C. 154(b) by 802 days.

(21) Appl. No.: 15/136,882

(22) Filed: Apr. 23, 2016

(65) Prior Publication Data

US 2021/0024245 A1 Jan. 28, 2021

(30) Foreign Application Priority Data

Jun. 20, 2015 (EP) ..... 15020100

(51) Int. Cl.
*B65D 5/06* (2006.01)
*B65D 5/74* (2006.01)

(52) U.S. Cl.
CPC ..... *B65D 5/067* (2013.01); *B65D 5/74* (2013.01)

(58) Field of Classification Search
CPC .... B65D 5/067; B65D 5/74; B65D 2547/063; B65D 33/2508; B29C 66/43122; B29C 66/53247; B29L 2031/7166
USPC ..... 229/249, 125.42, 125.04, 213, 214, 217, 229/248, 915.1, 222; 220/260; 426/115
See application file for complete search history.

(56) References Cited

U.S. PATENT DOCUMENTS

| | | | | |
|---|---|---|---|---|
| 1,160,677 A | 11/1915 | Van Wormer | | |
| 2,613,421 A | 10/1952 | Madsen | | |
| 3,224,916 A | 12/1965 | Soloff et al. | | |
| 4,789,067 A * | 12/1988 | Silano | B65D 5/067 | 220/260 |
| 6,050,484 A * | 4/2000 | Galomb | B65D 5/701 | 229/213 |
| 6,164,826 A | 12/2000 | Petkovsek | | |
| 6,820,391 B2 | 11/2004 | Barmore et al. | | |
| 7,204,641 B2 * | 4/2007 | Stolmeier | B65D 31/10 | 383/120 |

(Continued)

FOREIGN PATENT DOCUMENTS

| | | |
|---|---|---|
| EP | 1 873 081 A1 | 1/2008 |
| EP | 1 873 083 A1 | 1/2008 |

(Continued)

*Primary Examiner* — Christopher R Demeree
(74) *Attorney, Agent, or Firm* — Birch, Stewart, Kolasch & Birch, LLP

(57) ABSTRACT

The invention is an improvement of the well-known gable top packaging, commonly seen in milk and juice products. The improvement lies in the opening and closing of such packaging with a pull-to-open type opening. This invention addresses the problem that this type of packaging not is water tight after opening. The invention solves this leaking problem by adding a so called zip lock fastener in the opening area of the package. Zip lock fasteners are characterized by having an interlocking groove and ridge that form a tight seal when pressed together. When the user is folding in the pouring spout the zip lock fasteners meet and form a liquid tight joint. The invention is concerning the type and function of the zip lock and its placement. The invention describes as well how to produce gable-top packaging with this new liquid tight zip lock closure.

6 Claims, 8 Drawing Sheets

(56) References Cited

U.S. PATENT DOCUMENTS

| | | | | |
|---|---|---|---|---|
| 8,360,643 | B2 | 1/2013 | Komro et al. | |
| 10,065,761 | B2 * | 9/2018 | Kansburg | B65D 5/5425 |
| 10,322,841 | B2 * | 6/2019 | Dahan | B65D 81/3205 |
| 2004/0007596 | A1 | 1/2004 | Laverdure | |
| 2004/0136618 | A1 | 7/2004 | Ausnit et al. | |
| 2005/0017029 | A1 | 1/2005 | Laverdure | |
| 2012/0195532 | A1 | 8/2012 | Koesters | |
| 2015/0183559 | A1 | 7/2015 | Luizzi et al. | |
| 2015/0183563 | A1 * | 7/2015 | Luizzi | B65D 47/122<br>426/122 |

FOREIGN PATENT DOCUMENTS

| | | | |
|---|---|---|---|
| EP | 2 039 620 | A1 | 3/2009 |
| WO | WO 00/45748 | A1 | 8/2000 |
| WO | WO 00/67603 | A1 | 11/2000 |
| WO | WO 2007/147568 | A1 | 12/2007 |
| WO | WO 2008/145164 | A1 | 12/2008 |
| WO | WO 2014/066026 | A1 | 5/2014 |

* cited by examiner

CLOSURES FOR CARTON BOARD PACKAGING OF GABLE TOP TYPE AND SEALING THEREOF

GOVERNMENT SUPPORT STATEMENT

This work has been conducted without any support of any government.

REFERENCE TO PROVISIONAL PATENT

The present applications claims priority to the earlier filed provisional application having Ser. No. 62/152,056, and hereby incorporates subject matter of the provisional application in its entirety.

BACKGROUND

The use of carton for packaging of liquids and solids are in use globally. They are used predominantly in packaging of liquids such as milk or juice. A preferred type is the so called gable top packaging, which is sealed at the top by a folding like a roof top or a gable. This folding enables a repeated opening and closing of the packaging by means of the formed spout that can be pulled out for pouring and tucked in after use.

The closing of this packaging suffers from a severe drawback as is only liquid tight by the factory welded sealing. After the first opening of the user, the closure is not liquid tight any more. The common solution to this problem has been to put a plastic cap on one of the gable sides. This solution is cumbersome to open and is not seen as environmental friendly as a lot of plastic material is used in the cap.

This invention overcomes the drawback of the above mentioned solution by means of a small plastic sealing strip in the thermo-welded seam in the gable top. This device is liquid tight, reusable/reseal able, easy to seal and open and use only a small amount of plastic material.

BRIEF SUMMARY OF THE INVENTION

This invention relates to a gable top type carton container made from blanks of paperboard. The blanks are provided with a thermoplastic coating or layer on both surfaces. The blanks are also provided with a plurality of walls and fold lines to facilitate its assembly. This type of container is well described in Prior Art. The invention deals with the opening and closing of such container. See FIG. 1.

The invention is based upon the mechanical self-locking properties of so called zip locks fasteners and the similar. The function and use of such fasteners is also well described in Prior Art. The invention focuses on a novel use of such fasteners in connection to the above mentioned gable top type of containers.

The sealing is based on two perpendicular opposite hook shaped profiles and tongue and groove sealing profiles that are joined by manual force to interlink them. These profiles are designed such that the hooks attach to each other and the tongue and groove parts form a liquid tight seal. In addition the profiles have flexible fins or tubes in the lower part to seal the seepage opening of the closed gable top container. The sealing action is provided by the fins or tubes as they put adequate pressure on the container walls where the liquid can seep out and simultaneously form a flexible seal against the surfaces in question. These novel sealing strips are joined to the inner walls of the cardboard packaging at the gable top to create a perpendicular seal of the two joining halves of the seal. The joint is strong enough to withstand the pressure of the content, being liquid or solid, if turned up-side down. The nature of this joint is liquid tight. This closure is reclosable by the very nature of the zip lock type seal. The opening and closing cycle, with intact properties, are reproducible far beyond the lifecycle of the packaging.

The positions of the novel sealing strips are such as they don't come in contact with the content of the container and thus may contaminate said content. The novel sealing strips are placed in a novel position where it doesn't interfere neither with the standard factory heat-sealing/welding neither of the container nor with the outward flow of the content of the container. The novel sealing strips are integrated in the inner plastic coating of the cardboard packaging, thus being part of the basic production of the packaging blanks. Alternatively the novel sealing strips are joined to the cardboard blanks at the filling machine or in-line when the erected cardboard container is in the filling line. Several options for the placement of the novel sealing strips are feasible and illustrated in several examples showing the different properties these joints have.

DETAILED DESCRIPTION OF THE INVENTION

Containers for beverages such as milk, fruit juices, and drinks are conventionally constructed from blanks of thermoplastic coated paperboard.

The most widely use of such containers has a rectangular cross-sectional body surmounted by a gable-top closure incorporating an extensible pouring spout. Blanks from which the containers are constructed are divided into a plurality of panels which are adapted to form the walls and closure members. The panels are formed and separated by score lines at which the blank is folded. Particular panels are intended to be joined together in a lapped arrangement in the completed container. Typically, those panels are heated and pressed together or exposed to ultrasonic energy to fuse the adjoining thermoplastic surfaces and form a generally strong seal. To finally seal the filled container, two or more panels are finally joined and sealed to form a rib along the top edge of the roof panels. This procedure is well described in Prior Art.

Figure 1A:
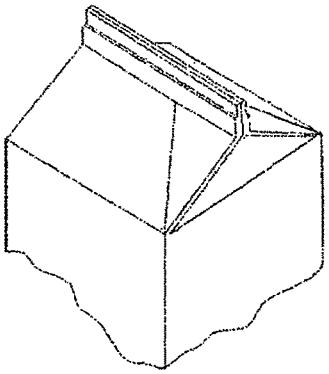
FIG. 1A to 1C shows a typical opening sequence of an gable top container FIG. 2 exterior of upper part of gable top blanks FIG. 3 interior of upper part of gable top blanks FIG. 4 a close-up of the positioning of the plastic novel sealing strips on the interior of the blanks.
Figure 1B:
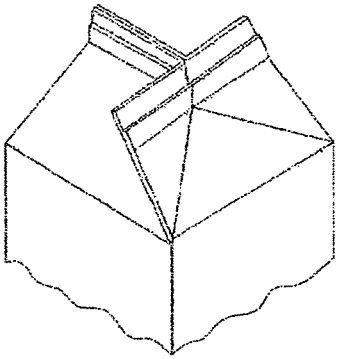
Figure 1C:
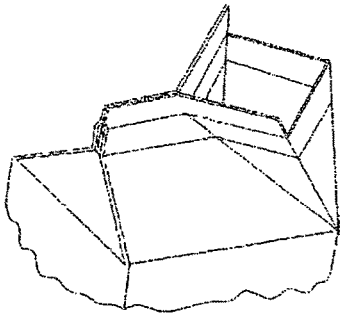

Containers of this type are opened for access to the contents by a three-step toggle action process, see FIG. 1A to 1C. First, the gable edges of the roof panels at the front of the container are pushed outward and upward toward the rear of the container by finger pressure, breaking the seal between the outside surfaces of the two top panels, and breaking the seal in the rib panels surmounting the roof above the pouring spout Second, the gable edges are forced backward past the point at which the lip panels are joined, to nearly touch the roof panels FIG. 1B. Third, the gable edges are pushed forward and towards each other. The forces are communicated through spout panels to the tip of the pouring spout, breaking the seal between the lip panels and the underside of the roof panels and snapping the spout outward to a pouring position FIG. 1C. The closing is a reverse of above described toggle action. The closed container is not liquid tight as fluid may seep out of the seals that were broken in the first opening described above. This mode of sealing and opening is also well described in prior art.

An improvement in gable-top containers to provide a hermetic seal for an extended shelf life package consisted of coating the inner surface of the container blanks with a foil and an over covering layer of a thermoplastic such as polyethylene. The panels to be sealed are bonded by heating the thermoplastic surface coatings to a softening or melting temperature, compressing the panels together and cooling. The use of thermoplastic coatings or foil adds some stiffness to the panels, and the container is made resistant to wicking by liquids.

The disclosed invention is only concerned with opening and sealing of gable top containers. The folding and welding of the packaging bottom and sides is well described in prior art.

The closing of this container suffers from a severe drawback as is only liquid tight by the factory welded sealing. After the first opening of the user, the closure is not liquid tight any more. The common solution to this problem has been to put a plastic cap on one of the gable sides. This solution is cumbersome to open and is not seen as environmental friendly as a lot of plastic material is used in the cap.

This invention overcomes the drawbacks of the above mentioned by means of a small plastic sealing strip in the thermo-welded seam in the gable top. This device is liquid tight, reusable/reseal able, easy to seal and open and use only a small amount of plastic material.

Blanks and Container Thereof

Figure 2:
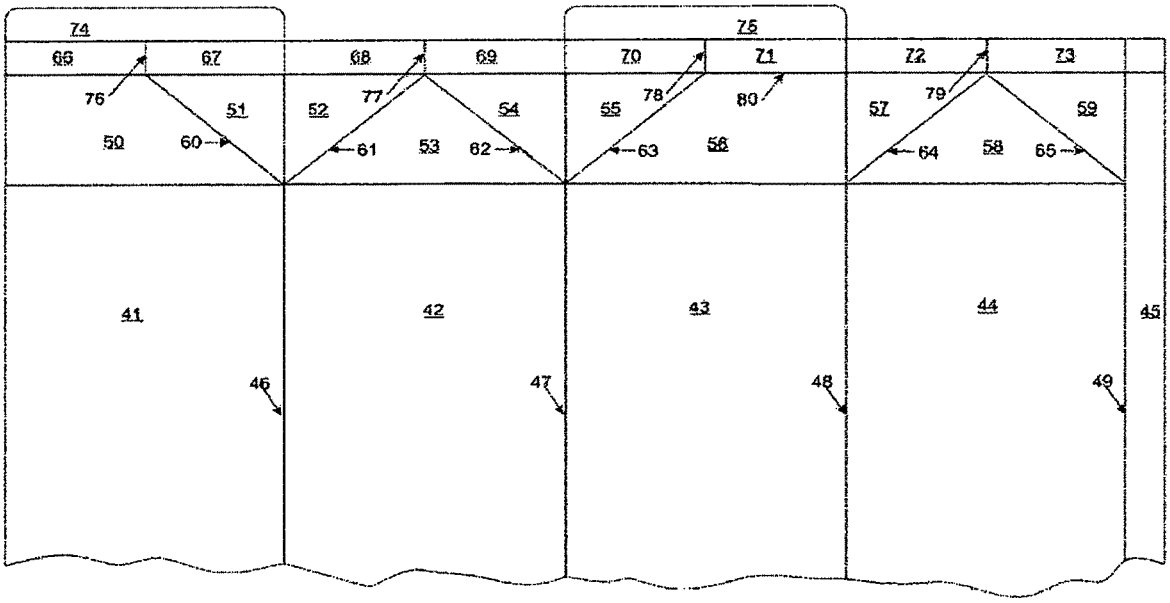
Figure 3:
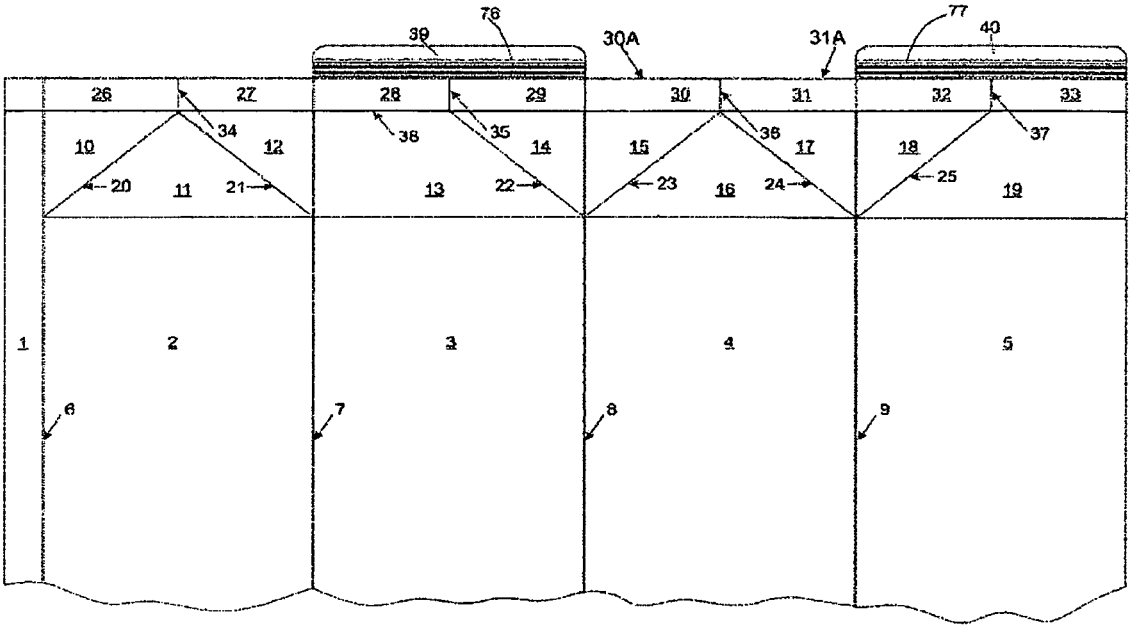

FIG. 2-3 illustrate the upper part of gable top blanks of the invention both from the interior and exterior perspective. The blanks consist of a single sheet of cardboard cut to exact size. The blanks are produced with score lines, e.g. 46-49 in order to make the folding of the container easy and to the right shape. The invention focuses on interior panels 30 and 40 where the novel sealing strips are positioned.

Top panels 29-30 and panel 31-32 and score line 36 form the upper part of the spout. Whereas gable panels 14-18 form the gable part of the spout in conjunction with score lines 35, 22, 23, 24, 25 and 37. The edges 30A-31A are connecting the edge between the inner and outer part of the container.

Figure 4:
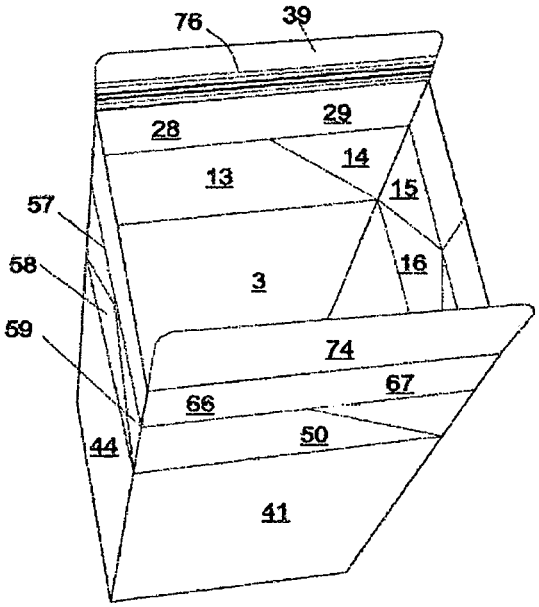

FIG. 4 illustrate the blanks in FIG. 2-3 in a folded, welded sides and upright position with the gable top open before the final closing of the container. The novel sealing strip 76 is shown on surface 39. This the typical container before filling and sealing of the gable top.

Figure 5:
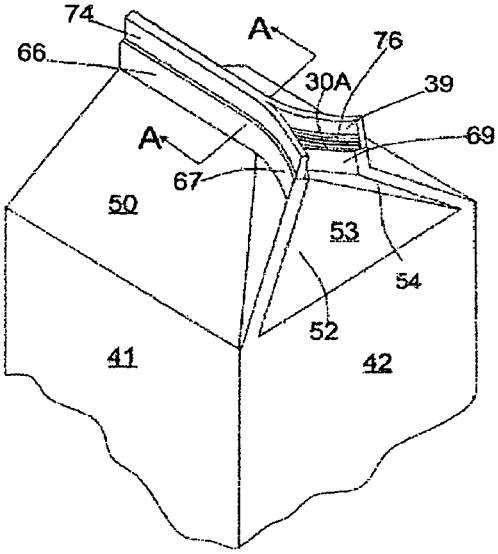
FIG. 5 an illustration of the gable top container in a semi open position. The sealing strip 76 is visible and is sealing against surface 30A.

FIG. 5 shows the aforementioned container in a semi closed/open position. The sealing strip 76 mounted on surface 39 is sealing edge 30A. The sealing is made by the closing action of the gable top spout where 67 and 70 is pushed inwards towards 68-69. In this step the edge 30A come in physical contact with the sealing strip 76. The proximity of 30A and the sealing fins/tubes of 76 form a liquid tight seal. An identical situation is taking place on the opposing side involving 77 and 31A.

Figure 6:
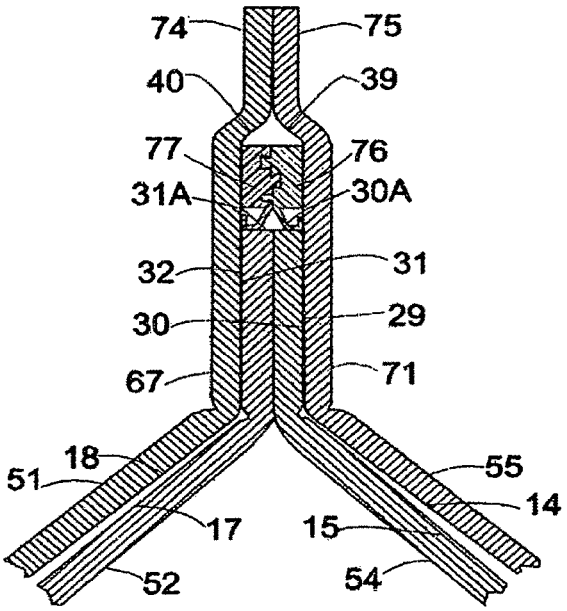
FIG. 6 a close up of cross section A-A in FIG. 5. The position of the sealing strips 76, 77 and its sealing against surface 30*a* and 31*a* is shown FIG. 7 a gable top container with the novel sealing strips 76, 77 in an open position FIG. 8 a gable top packaging with the novel sealing strip closure in a fully open position

A cross section of FIG. 5 along section A-A is shown in FIG. 6 where the sealing strips 76 and 77 are placed in the inner compartment made up of edges 30A and 31A and surfaces 18 and 14. The sealing strips are sealing the seepage point between surfaces 14-15 and 17-18 and edge 30A and 31A. In this example the sealing is performed by fins giving sufficient pressure to seal the seepage.

Figure 7:
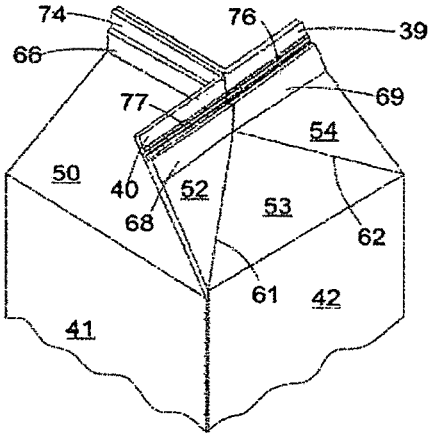

FIG. 7 shows the container in a half way open/closed position as in FIG. 1B. Top panels 39 and 40 comprise the novel sealing strips 76 and 77. The novel sealing strips forms a tight seal with outer panels 68-69 and the edge 30A and 30B. The novel sealing strips have sealing fins or tubes to make a liquid tight seal between 76-77 and 30A and 31A.

Figure 8:
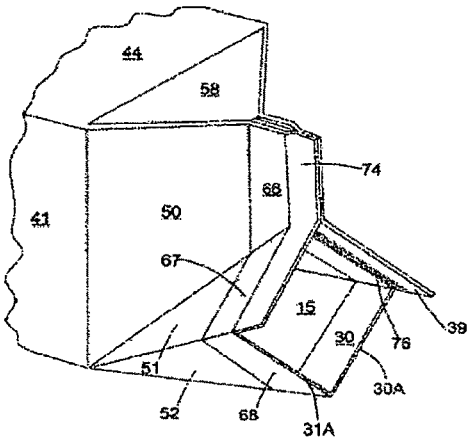

FIG. 8 shows a gable top container with the novel sealing strip in a fully open position. The sealing strips 76-77 are positioned on panels 39-40 so to avoid coming in contact with the contained liquid. This position avoids contamination of the contained liquid by not flowing over the sealing strips. Liquid flowing over sealing strips will unavoidably coat the sealing strip and cause a fouling. This fouling is unwanted and potentially hazardous as microorganisms can grow in this fouling. The novel positioning of the sealing strips will ensure a safe and fouling proof use of the gable top container.

Process

Figure 9A:
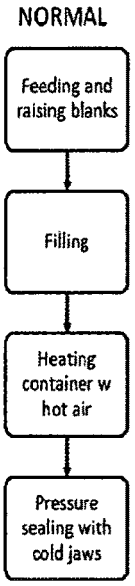
FIG. 9A shows a normal filling process. 9B shows the novel process where the novel sealing strips are mounted prior to the filling. 9C shows the novel process where the strips are mounted in parallel with the sealing of the container.
Figure 9B:
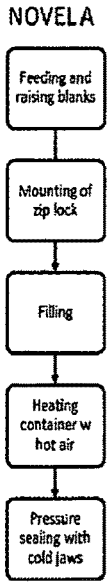
Figure 9C:
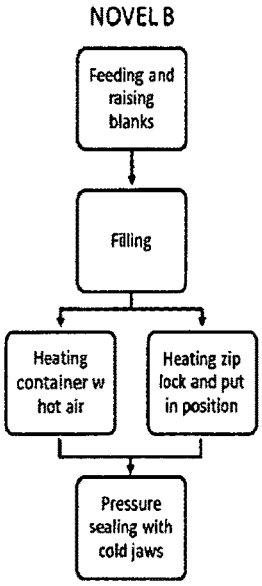

The sealing processes are shown in FIG. 9A to 9B. Conventional filling is shown in 9A as the NORMAL process The invention uses one more step as shown in process FIG. 9B NOVEL A where welding of the sealing strips to the erected but empty containers are made. In FIG. 9C process NOVEL B, the sealing strips are feed into the opening of the semi-open container. The sealing rails are preheated to plasticized temperature prior to be placed on edges 30A and 31A and the length of the gable top in parallel with the heating of the filled container to plasticize the inner lining of the container. The novel process is illustrated schematically as a conveyor belt in FIG. 10 in which:

① is an semi closed container in which the assembled and pre heated plasticized sealing rails is approaching its position ② is an almost closed container in which the plasticized sealing rails are positioned properly prior to the pressure sealing.

The sealing rails are pre heated to the same temperature as the packaging interior by unit A. Residual sealing strip is cut of at B.

Figure 10:
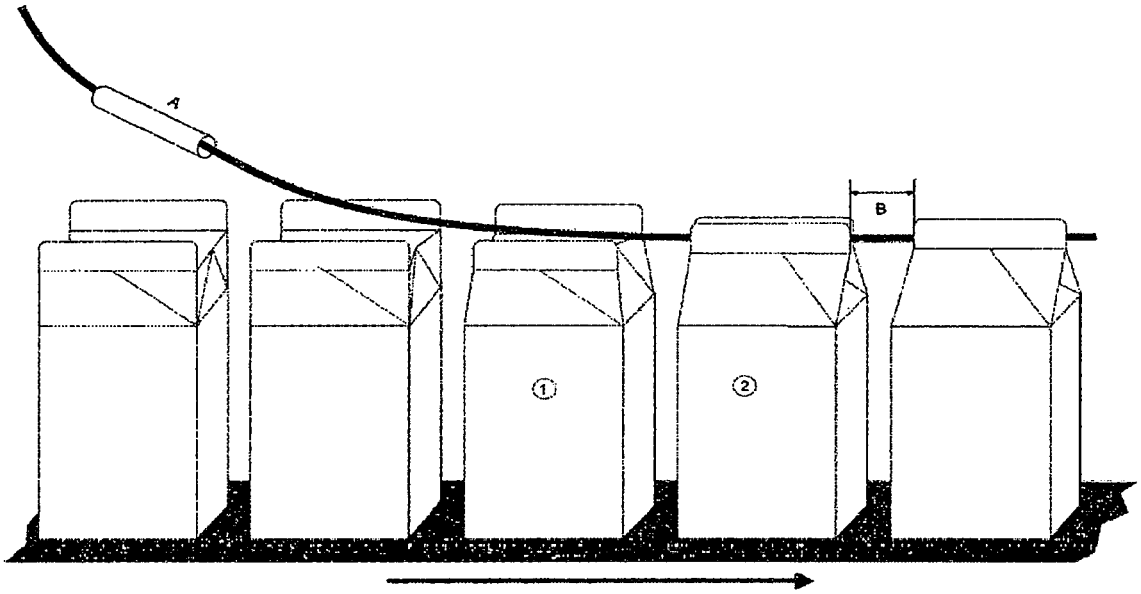
FIG. 10 a schematic view of the filling and sealing of the container. Pre heater A heats the plastic strips. The pre heated sealing strips are positioned in place in container ① and sealing is commencing in container ②. Sealing strip over hang B is cut off.
Figure 11:
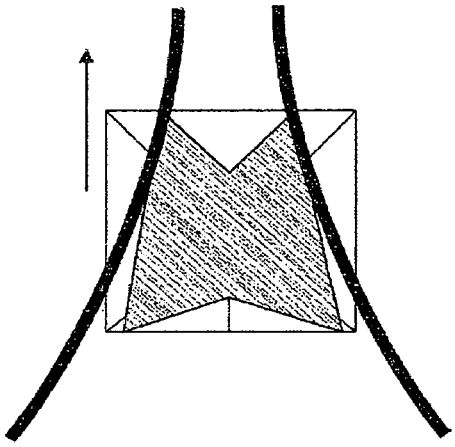
FIG. 11 a top view of the container ① in FIG. 10 showing the guiding rails forcing the gable top in position for final closing FIG. 12 a top view of the container ② in FIG. 10 showing the guiding rails forcing the gable top in position and the pre heated sealing strip put in place prior to final closing FIG. 13 a schematic view of the welding of the sealing strips in-line. The apparatus for ultrasonic welding ① and counter hold ② is shown.
Figure 12:
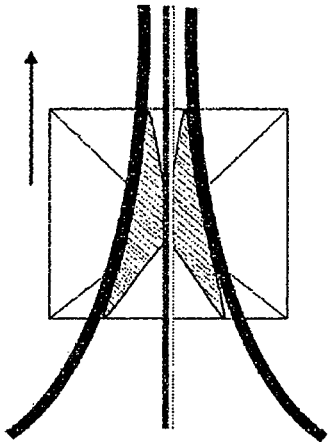

FIG. 11 illustrate step ① in FIG. 10, from above where the guiding rails are commencing the forming of the gable top. FIG. 12 is the following step ② in FIG. 10, from above in which the semi-closed container and the preheated assembled sealing rails are coming together and the rails are beginning to find its position.

Apparatus

Figure 13:
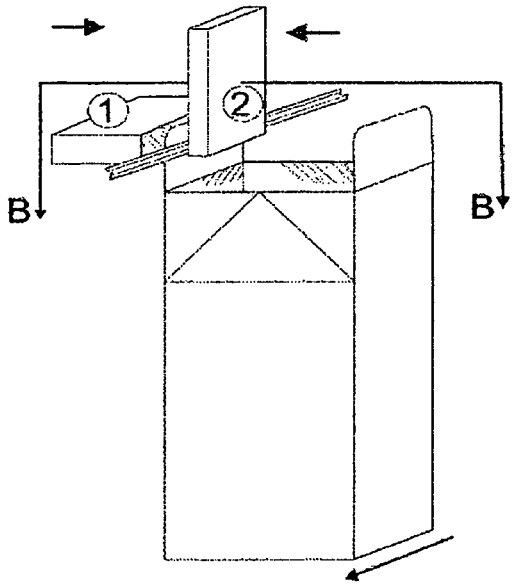

The welding of the sealing strips on the erected container is shown in FIG. 13. The figure shows the welding on one side of the container. Item A is equipment for welding of plastic to cardboard using existing technology such as ultrasonic energy. Item B is a counter hold that fixes the sealing strip to the cardboard and makes adequate counter pressure to said item A to form a strong weld. The welding on the opposite side is done in an identical operation. The novel sealing strip is provided either on string or on roll where the sealing strips are disassembled.

The novel sealing strip is either:

1. Cut to size and applied
2. Applied as is on the roll and welded in-line

Figure 14:
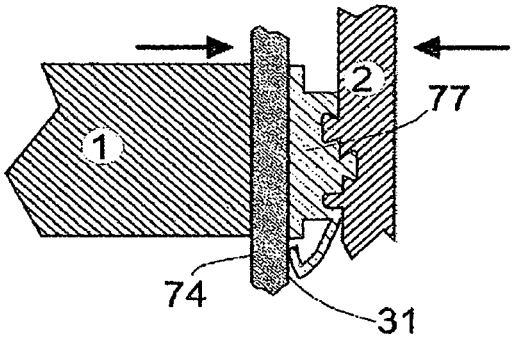
FIG. 14 a close up of cross section B-B in FIG. 13. The ultrasonic welding ① and counter hold ② is shown. Pressure force is indicated by the arrows.

FIG. 14 is a close up of a cross section along B-B of the welding in FIG. 13. Item ① is providing adequate energy by e.g. ultrasonic energy to plasticize the plastic coating of the inner surface of the container and the surface of the sealing strip in contact with the plastic coating. The energy is sufficient to plasticize the compressed surfaces but not to affect the sealing strip design and function.

Novel Sealing Strips

The sealing strip is consisting of interlocking profiles which has been shown in prior art and is well known as e.g. zip locks. The material of choice is the same as the inner lining of the carton board, typically polyethylene. The novel sealing strip consist of, besides mirroring and/or clasping profiles, flexible fins or tubes which acts as sealing rails against edge 30A and surface 30 and similarly edge 31A and surface 30. The tension of the fins or tubes is adequate to create a pressure of the fins or tubes against the seepage opening between 29-30 and 31-32. The sealing strip profile has an extra liquid proofing feature in a tongue and groove profile just above the fins in order to proof the liquid tightness of the seal. This profile acts as well as homing guides for the proper joining of the strips.

Figure 15:
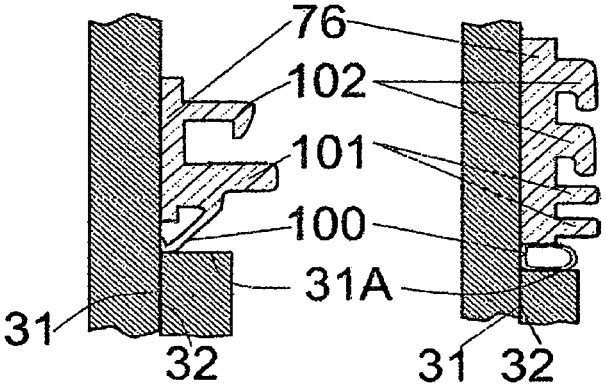
FIG. 15 a schematic cross section illustration of the sealing principle. Interlocking hooks 102, horning tongue and groove 101 and sealing fins/tubes 100 is shown.

The novel sealing strips must fulfill the functions and specifications below in order to operate according to claim 2:

- Re-closable and re-sealable for the life time of the carton container
- Sealing edge 30A vs 29-30 and 31A vs 31-32 liquid tight
- Sealing corner 35-37 liquid tight
- Easily attached onto the blanks or the container in an adequate way
- Sealing rails must be able to homing the sealing strips into place FIG. 15 is schematic cross section drawing of the sealing function at the seepage line along 31 and 32. The novel sealing strip 76 is sealing along 31-32 by having flexible fins 100 or tubes 100 that put adequate pressure in the corner of 31-31A. 101 are the interlocking guides and sealing plugs and 102 are the interlocking hooks of the sealing strip. Same principle applies for the novel sealing strip 77 at the seepage at 29-30.

Several designs are feasible to meet the demands above. A number of examples are given in FIGS. 16-19.

Figure 16:
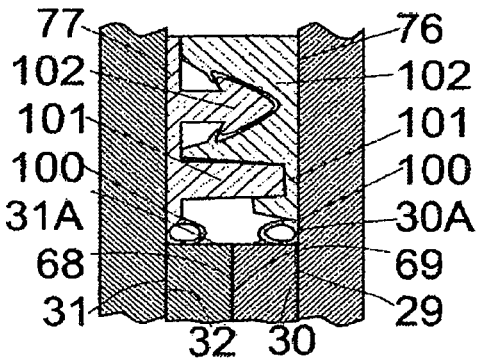
FIG. 16 an example of the sealing strips utilizing tubes for the sealing against 31-31A. Arrow shaped hooks are used.

FIG. 16 is an example of a cross section of a sealing strip fulfilling the demands above. This type uses flexible tubes 100 to accomplish the sealing action. The interlocking is accomplished by a male arrowhead and a female funnel with locking fins 102. The guiding is accomplished by a tongue and groove profile 101.

Figure 17:
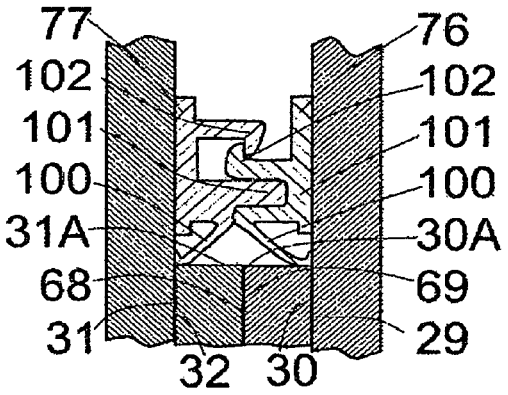
FIG. 17 an example of the sealing strips utilizing fins for the sealing against 31-31A. Mirroring hooks are used.

FIG. 17 is also an example of a cross section of a sealing strip fulfilling the demands above. This type uses flexible fins 100 to accomplish the sealing action. The interlocking is accomplished by interlocking hooks 102. The guiding is also accomplished by a tongue and groove profile 101.

Figure 18:
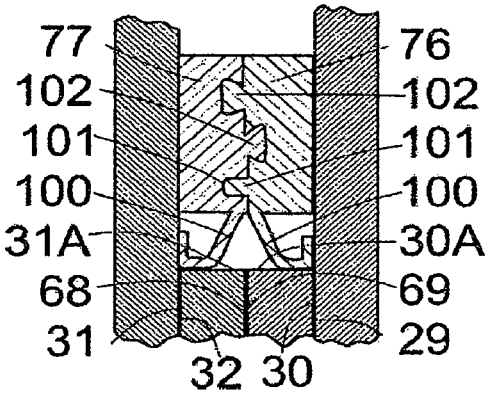
FIG. 18 an example of the sealing strips utilizing fins for the sealing against 31-31A and interlocking profiles.

FIG. 18 is also an example of a cross section of a sealing strip fulfilling the demands above. This type also uses flexible fins 100 to accomplish the sealing action. The interlocking is on the other hand accomplished by an interlocking profile 102. The profiles are mirror images and uses male-female wedge shaped interlocking parts. The guiding is also a tongue and groove profile 101.

Figure 19:
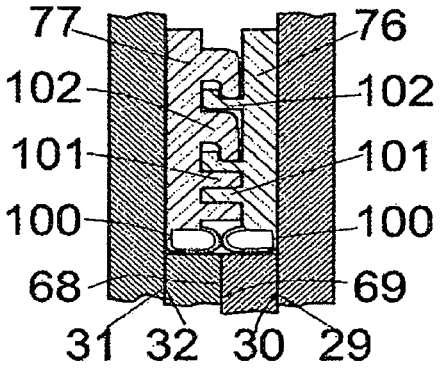
FIG. 19 an example of the sealing strips utilizing tubes for the sealing against 31-31A and hooks FIG. 20 the sealing strips in FIGS. 17 and 18 in a fully open position showing the sealing fins in a relaxed state.

FIG. 19 is also an example of a cross section of a sealing strip fulfilling the demands above. This type uses flexible tubes 100 to accomplish the sealing action. The interlocking is accomplished by interlocking hooks 102. The hooks are asymmetrical in order to have a close and open operation. The guiding is also accomplished by a tongue and groove profile 101.

Figure 20:
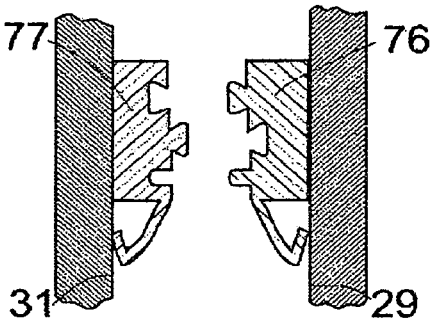
Figure 21:
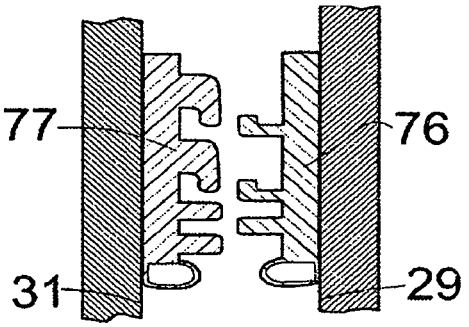
FIG. 21 the sealing strips in FIGS. 16 and 19 in an open position showing the sealing tubes in a relaxed state.

FIG. 20 illustrate, as an example, a close up of the sealing strip in FIG. 18 in a fully open position. The sealing fins are now in a relaxed position. When the container is closed and edge 30A and 31A is pushed in place the sealing fins meet these edges and are pushed upwards and finally meet surfaces 29 and 31 and exerts a sealing pressure onto these surfaces. The seeping opening between 29-30 and 31-32 are thus tightly sealed. FIG. 21 is similarly showing, as an example, sealing strips using tubes as in FIG. 19 in a relaxed state.

Auxiliary Features

The amount of plastic material that is consumed by the novel sealing strip is considerably less than the contemporary screw caps. The weight of the novel sealing strip is typically less than 1 gram whereas the typical screw cap weight is more than 4 gram. Thus the material use is more than 4 times for the screw caps. Packaging is nowadays considered environmentally friendly if they use less non-renewable material. A plastic that is petroleum based is considered non-renewable. The invention uses at least 4 times less plastic material than the prevailing plastic screw caps.

In order to make the contemporary screw caps liquid tight the cap is screwed on to the threaded neck with strong force. This makes the first opening of the cap cumbersome for users with little hand power as the cap in itself is hard to grip. This invention overcomes this simply by using less force in the first opening which is a standard operation in gable top opening and well established as a user friendly opening.

Feasibility

The invention has been verified in a number of prototypes by adding sealing strips in existing gable top packaging.

Figure 22:
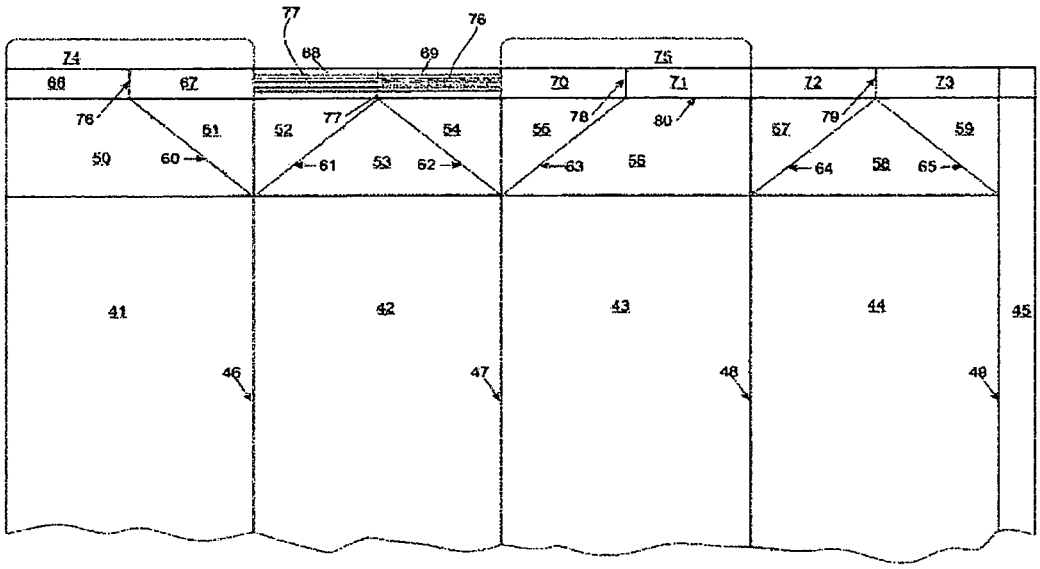
FIG. 22 an example of the exterior of a blank with the sealing strip in an alternative position on 68-69.
Figure 23:
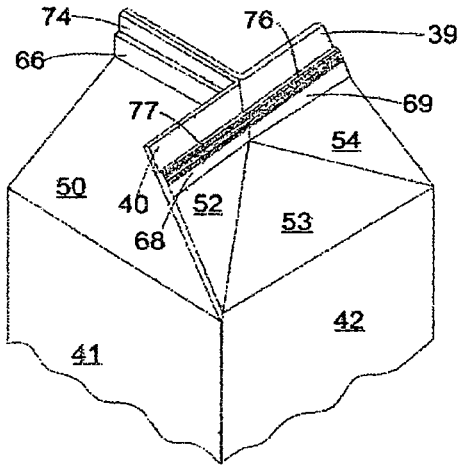
FIG. 23 the gable top container of blanks in FIG. 22 with in a semi open position with the sealing strips on surface 68 and 69.
Figure 24:
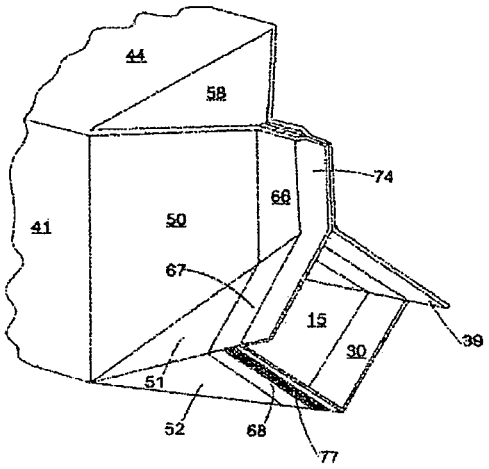
FIG. 24 the gable top container of blanks in FIG. 22 with in a fully open position with the sealing strip on surface 68.

Example 1 Alternative Positioning of the Sealing Strips on the Blanks or in the Container As previously stated there are many positions for sealing strips in a gable top closure. Example 1 illustrates the option of placing the sealing strips on the exterior on panels 68 and 69 as shown in FIG. 22. The sealing strips are positioned at 68 and 69. This will hold the wing/flaps 52 and 54 in place but will not constitute a liquid tight seal as seepage will occur at the gap between 29-30 and 31-32. FIG. 23 illustrate the aforementioned blanks in a folded and welded position with open and semi-open spout. This position will yield a somewhat bulky design as six sheets (four from cardboard and two from strips) make up the final product. FIG. 24 shows the container in FIG. 23 in a fully open position where it can be seen that this position of the sealing strips avoid contact between the strips and the contained liquid.

Figure 25:
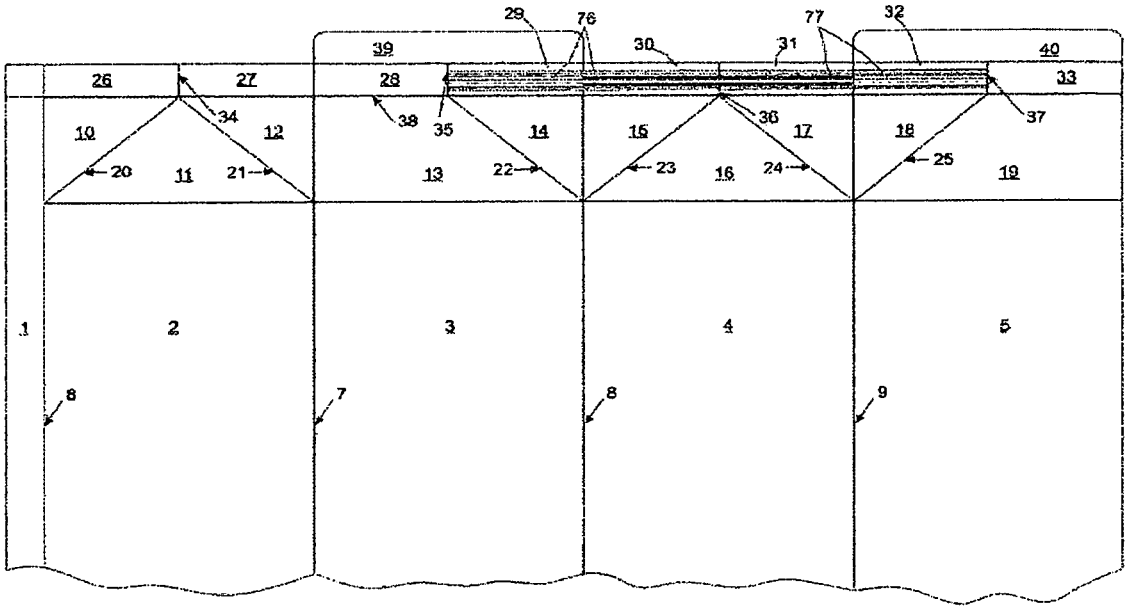
FIG. 25 example of the interior of a blank with the sealing strip in an alternative position on 29-32.

Example 2 Alternative Positioning of the Sealing Strips on the Blanks or in the Container Yet another position is shown in FIG. 25 in which the sealing strips are positioned on the interior of the blanks. The sealing strips are positioned on 29-32 with male part on 29 and 31 and female part on 30-31.

Figure 26:
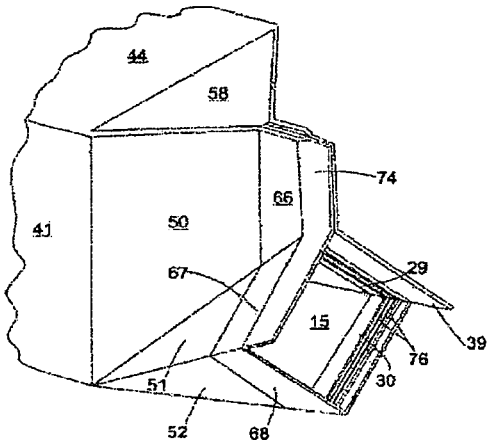
FIG. 26 the container made of blanks in FIG. 25 in a fully open position with the sealing strips on 29-30.

This gives a very bulky design as eight sheets (four from cardboard and four from sealing strips) make up the final product. FIG. 26 shows the aforementioned blanks in a folded and welded position with a fully open spout. As can be seen the strips interfere with the content to be poured out as it will flow over 30-31 and thus 76-77. This type of container is therefore more suitable for non-liquid content. These positions of the sealing strips are somewhat similar to U.S. Pat. No. 6,820,391 B2 in which a zip sealed spout for vertical form/fill/seal applications are disclosed.

REFERENCES

The blanks, containers, apparatus and process of making gable tops containers for liquids are well described in Prior Art dating way back to John van Wormer's (1) patent in 1915. Polyethylene film coated blanks (liquid paper board) for use in beverage applications was introduced to the market in 1953. The design, apparatus and process of making so called zip locks (sealing strips) dates back to Börge Madsen's (2) patent in 1952.

But the use of sealing strips based on the zip lock principle in the sealing and resealing of gable top containers is new to the market place and no patents are found that clearly interferes with this invention. Prior art describes the use of zip lock type closures in vertical form/fill/seal (VFFS) gusseted pouches and their production is disclosed in U.S. Pat. No. 6,820,391 B2 in which a zipper closed spout is described. This patent claims apparatus for VFFS production based on a lay flat plastic film. Several patent applications has been made by company Nordenia D Halle GMBH in Germany for plastic containers with reclosable spouts such as US 2012/0195532 (4) and priority application EP111527172, EP2039620 (5), EP1873083 (6), EP1873081 (7), EP2148820 (8) and EP2032454 (9). Similarly patents for plastic bags or pouches with gussets and spout are disclosed, such as U.S. Pat. No. 8,360,643 (10) and U.S. Pat. No. 6,164,826 (11).

In prior art adhesive films are positioned in the spout to accomplish the closing operation of gable top containers. Adhesive films are also used in the same position to ease the opening of the container such U.S. Pat. No. 6,820,391 (12).

Ultrasonic welding dates back to Robert Soloff et al U.S. Pat. No. 3,224,916 from 1965 (13). The technology has developed since then and become a standard operating procedure for welding plastics material.

The addition of sealing elements to zip lock type fasteners and the application in gable top packaging is to us not known in Prior Art.

REFERENCES

| | | | | |
|---|---|---|---|---|
| (1) | U.S. Pat. No. 1,160,677 A | van Wormer | 1915 Nov. 15 | Paper milk-bottle or other container |
| (2) | U.S. Pat. No. 2,613,421 A | Madsen | 1952 Oct. 14 | Slide fastener |
| (3) | U.S. Pat. No. 6,820,391 B2 | Barmore et.al | 2004 Nov. 14 | Apparatus for making a reclosable pouch. |
| (4) | US 2012/0195532 | Kösters | 2012 Aug. 2 | Film bag for packaging of pourable products |
| (5) | EP2039620 | Kösters | 2009 Mar. 25 | Bag with side gusset |
| (6) | EP1873083 | Brauer et al | 2008 Jan. 2 | Plastic film bag |
| (7) | EP1873081 | Brauer et al | 2008 Jan. 2 | Bag and method for making it |
| (8) | EP2148820 | Kujat et al | 2010 Feb. 3 | Sheet-material packaging bag |
| (9) | EP2032454 | Brauer et al | 2009 Mar. 11 | Film bag |
| (10) | U.S. Pat. No. 8,360,643 | Komro et al | 2013 Jan. 29 | Package having a resealable pour spout |

-continued

| | | | | |
|---|---|---|---|---|
| (11) | U.S. Pat. No. 6,164,826 | Petkovsek | 2000 Dec. 26 | Resealable spout for side-gusseted packages |
| (12) | U.S. Pat. No. 6,820,391 | Marovskis | 2000 Feb. 15 | Gable-top containers and container blanks |
| (13) | U.S. Pat. No. 3,224,916 | Soloff et al | 1965 Dec. 21 | Sonic method of welding thermoplastic parts |

The invention claimed is:

1. A re-closable container of rectangular cross-section for packaging of a liquid, comprising:

a blank of thermoplastic coated paperboard, said blank having score lines for separating foldable panels, including a gable top part being foldable so as to initially form a closed position of the container, with a liquid tight seal between two adjoining upper gable side walls at said gable top part, said liquid tight seal being manually separated to form an upper spout, formed by a number of spout panels for dispensing liquid from the container, said spout panels being manually foldable back to a closed position, a re-closable and re-sealable zip lock fastener with two sealingly interlocking strip profiles of a thermoplastic material secured to said two adjoining upper gable side walls, at said gable top part, each sealingly interlocking strip profile being attached to an associated one of said upper gable side walls, wherein said two adjoining upper gable side walls, at said gable top part, with said sealingly interlocking strip profiles forming a re-closable and re-sealable zip lock fastener, are located above said spout panels and extend only along an uppermost top portion of the container and thus only along half of said upper spout when the spout is open for dispensing liquid, and wherein each of said sealingly interlocking strip profiles of said re-closable and re-sealable zip lock fastener, at its lower side, is provided with a flexible sealing fin or tube exerting a sealing pressure, when said spout panels are folded back to their closed position, on an upper edge surface of an associated one of said spout panels and also on an adjoining spout panel located next to said associated spout panel when the spout panels are folded back to said closed position, whereby any seepage of liquid from the container is prevented after folding back the spout panels to their closed position.

2. The re-closable container as defined in claim 1, wherein said sealingly interlocking strip profiles comprise opposite hook parts for mechanical interlocking and opposite tongue and groove parts for guiding and sealing.

3. The re-closable container as defined in claim 2, wherein said flexible sealing fins or tubes are attached to said tongue and groove parts, respectively.

4. The re-closable container as defined in claim 3, wherein said sealingly interlocking strip profiles are attached to said upper gable side walls by welding.

5. The re-closable container as defined in claim 2, wherein said sealingly interlocking strip profiles are attached to said upper gable side walls by welding.

6. The re-closable container as defined in claim 1, wherein said sealingly interlocking strip profiles are attached to said upper gable side walls by welding.

* * * * *